US006232726B1

(12) United States Patent
Janczak

(10) Patent No.: US 6,232,726 B1
(45) Date of Patent: May 15, 2001

(54) BALLAST SCHEME FOR OPERATING MULTIPLE LAMPS

(75) Inventor: Jerzy Janczak, Woodhaven, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/473,535

(22) Filed: Dec. 28, 1999

(51) Int. Cl.[7] ..... H05B 37/02

(52) U.S. Cl. ..... 315/224; 315/250; 315/256; 315/307

(58) Field of Search ..... 315/224, 250, 315/254, 255, 256, 307, 312, 324, 376, 277, 130

(56) References Cited

U.S. PATENT DOCUMENTS

| | | | | |
|---|---|---|---|---|
| 4,251,752 | | 2/1981 | Stolz | 315/206 |
| 4,293,799 | | 10/1981 | Roberts | 315/256 |
| 4,641,061 | * | 2/1987 | Munson | 315/210 |
| 4,870,327 | * | 9/1989 | Jorgenssen | 315/307 |
| 5,049,788 | | 9/1991 | Lee | 315/219 |
| 5,068,576 | * | 11/1991 | Hu et al. | 315/291 |
| 5,072,090 | * | 12/1991 | Morita | 219/108 |
| 5,742,134 | | 4/1998 | Wacyk et al. | 315/307 |
| 5,969,483 | * | 10/1999 | Li et al. | 315/225 |
| 5,998,930 | * | 12/1999 | Upadhyay et al. | 315/106 |

* cited by examiner

*Primary Examiner*—David Vu
*Assistant Examiner*—Tuyet T. Vo
(74) *Attorney, Agent, or Firm*—Bernard Franzblau

(57) ABSTRACT

A ballast including a single sense element and a single controller for mulitple lamp operation. The ballast avoids the need for separate feedpaths for sensing individual lamp conditions and/or the need for separate controllers for controlling the individual lamp conditions. Consequently, the ballast scheme avoids the use of expensive components (e.g. controllers and chokes) and minimizes the number of components required in order to operate multiple lamps.

20 Claims, 1 Drawing Sheet

BALLAST SCHEME FOR OPERATING MULTIPLE LAMPS

BACKGROUND OF THE INVENTION

This invention relates generally to a ballast scheme for operating multiple lamps and, more particularly, to a ballast scheme for operating multiple fluorescent lamps having substantially the same current flowing through each lamp.

Conventional ballasts for powering multiple lamps, such as disclosed in U.S. Pat. No. 4,293,799, include a plurality of transformers for isolating the lamps from direct connection to a utility line. The primary windings of the transformers are connected in series. The secondary winding of each transformer is connected to a lamp. Substantially the same current flows through each lamp when the lamps have substantially the same impedance.

Such conventional ballasts, however, often do not sense lamp load conditions so as to achieve/maintain one or more desired lamp parameters. These parameters can include, but are not limited to, the level of illumination, power regulation, preheat, ignition stop/cutoff and/or capacitive mode protection.

It is therefore desirable to provide an improved ballast for operating multiple lamps in which substantially the same level of current flows through each lamp. The improved ballast should include a scheme for sensing lamp load conditions in order to achieve/maintain one or more desired lamp parameters. The scheme should avoid the use of expensive components and minimize the number of components required.

SUMMARY OF THE INVENTION

In accordance with a first aspect of the invention, a ballast for powering more than one lamp includes an inverter having an output; a resonant inductor and a transformer for each lamp. Each transformer has a primary winding and a secondary winding. The primary windings are serially coupled together and to the resonant inductor. The ballast further includes a single sensing element for sensing the flow of current through all lamps and a controller for controlling the switching operation of the inverter in response to the sensed lamp current.

Each of the lamps has substantially the same current flow through serial coupling of the primary windings and resonant inductor to each other. There is no need to provide separate chokes for each lamp in order to balance the current flow among the lamps. The single sensing element senses the flow of current through all lamps. More particularly, the controller in response to the sensed lamp current controls the switching operation of the inverter in order to achieve/maintain one or more desired lamp parameters. Through the use of a single sense element and a single controller, the ballast avoids the need for separate feedpaths for sensing individual lamp conditions and/or the need for separate controllers for controlling the individual lamp conditions. The ballast scheme therefore avoids the use of expensive components (e.g. controllers and chokes) and minimizes the number of components required in order to operate multiple lamps.

It is a feature of this first aspect of the invention that each transformer has a secondary winding connected to a corresponding lamp. The inverter operates at a switching frequency above a resonant frequency, the resonant frequency being based on the impedance of the resonant inductor and each transformer. The single sensing element is preferably connected between a secondary winding of one of the transformers and a reference potential (e.g. ground potential).

In accordance with a second aspect of the invention, a method of operating a ballast for powering more than one lamp includes the steps of supplying an AC signal from an inverter to a resonant inductor and a plurality of transformers; sensing through a single sensing element the flow of current through all lamps; and controlling the switching operation of the inverter in response to the sensed lamp current. The serial combination of the resonant inductor and primary windings of each transformer receive the AC signal. Each transformer is associated with a different lamp.

It is a feature of this second aspect of the invention that the inverter be operated at a switching frequency above a resonant frequency, the resonant frequency being based on the impedance of the resonant inductor and each transformer.

Accordingly, it is an object of the invention to provide an improved ballast for operating multiple lamps in which substantially the same current flows through each lamp.

It is another object of the invention to provide an improved ballast scheme for sensing lamp load conditions in order to achieve/maintain one or more desired lamp parameters.

It is a further object of the invention to provide an improved ballast scheme which avoids the use of expensive components and minimizes the number of components required.

Still other objects and advantages of the invention will, in part, be obvious and will, in part, be apparent from the specification.

The invention accordingly comprises several steps in the relation of one or more such steps with respect to each of the others, and a device embodying features of construction, combination of elements, and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENT

Figure 1:
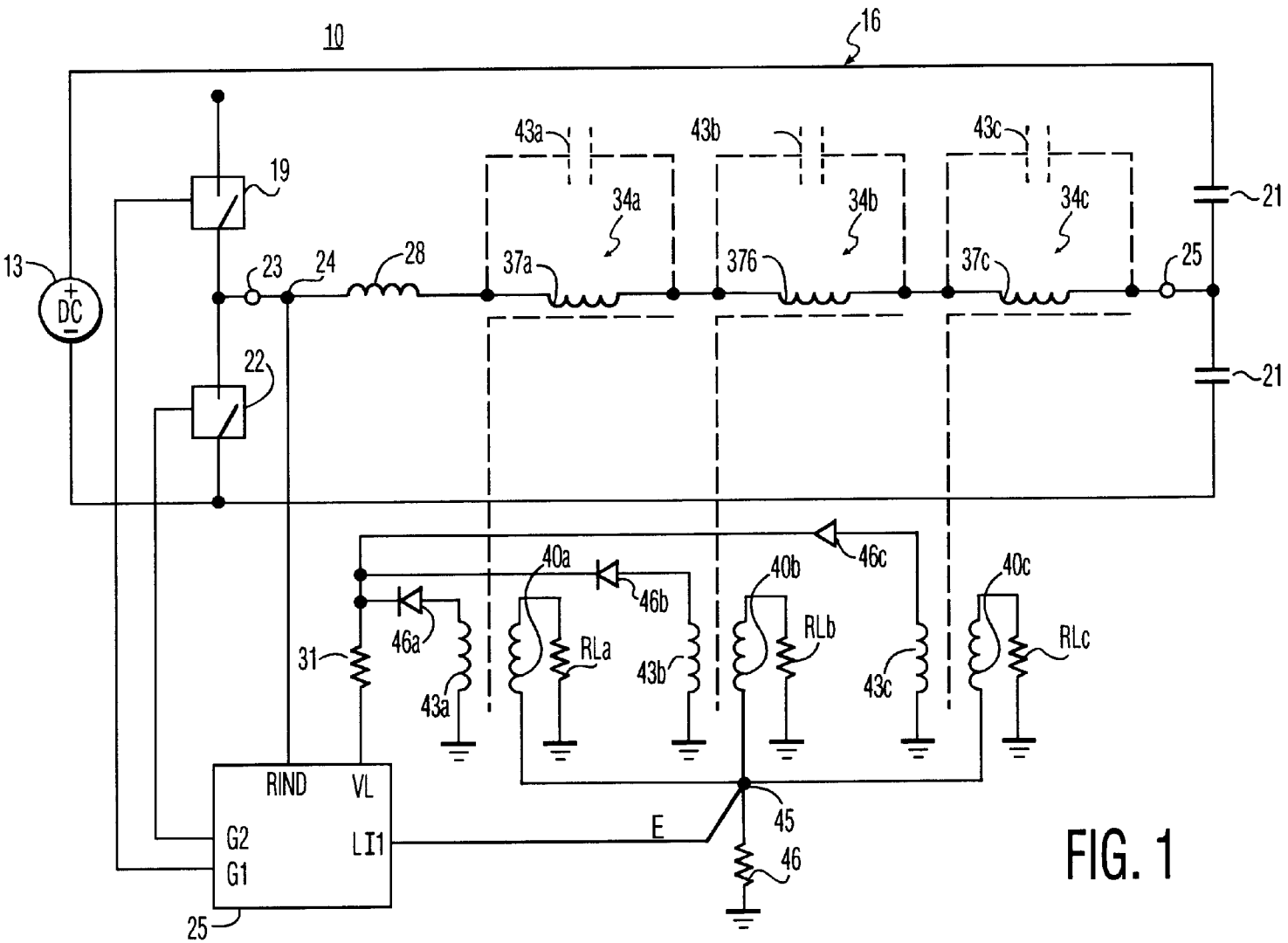
FIG. 1 is a schematic diagram of a ballast in accordance with the invention.

As shown in FIG. 1, a ballast 10 supplies a substantially DC signal from a DC source 13 to an inverter 16. Inverter 16 is shown in a half-bridge configuration but can alternatively be in a full bridge configuration. Inverter 16 includes a pair of switches 19 and 22 which typically are MOSFETs driven by a controller 25 and a pair of DC blocking capacitors 21. Switches 19 and 22 are connected in series (i.e. totem-pole configuration) across DC source 13. DC blocking capacitors 21 also are connected in series across DC source 13. Controller 25 produces a pair of driving signals at pins G1 and G2 for controlling the switching states of switches 19 and 22, respectively, that is, for controlling, in part, the switching frequency of inverter 16.

Inverter 16 produces an AC voltage at a pair of nodes 23 which serve as the output of inverter 16. Ballast 10 can power a plurality of lamps RLa, RLb and RLc. It is to be understood that the ballast configuration is designed to power any number of lamps and is not limited to the three lamps shown and described herein. Lamps RLa, RLb and RLc are coupled to the output of inverter 16 through the combination of a resonant inductor 28 and a plurality of transformers 34*a*, 34*b* and 34*c*, respectively. Each transformer 34*a*, 34*b* and 34*c* has a primary winding 37*a*, 37*b* and 37*c* coupled to a secondary winding 40*a*, 40*b* and 40*c* and to an additional secondary winding 43*a*, 43*b*, and 43*c*, respectively. Primary windings 37*a*, 37*b* and 37*c* and resonant inductor 28 are serially connected together. This serial combination is connected across the output of inverter 16. A balanced current (i.e. substantially the same current) flowing through each lamp RLa, RLb and RLc is achieved by serially connecting primary windings 37*a*, 37*b* and 37*c* together.

Lamp RLa is connected between secondary winding 40*a* and a reference potential (e.g. ground potential). Lamp RLb is connected between secondary winding 40*b* and the reference potential. Lamp RLc is similarly connected between secondary winding 40*c* and the reference potential. A junction 45 connects together secondary windings 40*a*, 40*b* and 40*c*. Secondary windings 40*a*, 40*b* and 40*c* are effectively connected in parallel and serially coupled to the reference potential through a resistor 46.

A resonant circuit is formed through the impedance of resonant inductor 28 and transformers 34*a*, 34*b* and 34*c*. The resonant capacitance of the resonant circuit is created by the parasitic capacitance of each transformer and is represented in FIG. 1 by resonant capacitors 43*a*, 43*b* and 43*c* connected in parallel with primary windings 37*a*, 37*b* and 37*c*, respectively. Alternatively, one or more discrete capacitors can serve as the resonant capacitance or in combination with the parasitic capacitors. The resonant inductance is formed by resonant inductor 28 by itself or in combination with the leakage inductance (not shown) of one or more of the transformers 34*a*, 34*b* and 34*c*.

Controller 25 is well known in the art and is disclosed in U.S. Pat. No. 5,742,134, the latter of which is incorporated herein by reference thereto. Controller 25 includes a plurality of pins including pins G1, G2, RIND, VL and LI1. Pins G1 and G2 produce the driving signals for controlling the switching states of switches 19 and 22, respectively. The RIND pin reflects the level of current flowing through a resonant inductor 28 and is connected to a junction 24 joining an output 23 of inverter 16 to resonant inductor 28. Inverter 16 also includes an output 25.

Pin LI1 in combination with a signal fed into another pin (not shown) of controller 25 reflects the current flowing through lamps RLa, RLb and RLc. More particularly, pin LI1 receives a sample of the current flowing through lamp RLb. Inasmuch as the currents through each of the lamps are substantially the same, the sample of the current flowing through lamp RLb which is fed into pin LI1 reflects the current flowing through each of the lamps. Pin LI1 is connected to a junction 45 joining resistor 46 to secondary winding 40*b*.

A voltage at a pin VL reflects the peak voltage applied to lamps RLa, RLb and RLc. A scaling resistor 31 is connected to pin VL for scaling down the voltage which would otherwise be applied to pin VL. The serial combination of additional secondary winding 43*a* and a diode 46*a* is connected between scaling resistor 31 and the reference potential (e.g. ground potential). The serial combination of additional secondary winding 43*b* and a diode 46*b* is connected between scaling resistor 31 and the reference potential. The serial combination of additional secondary winding 43*c* and a diode 46*c* is connected between scaling resistor 31 and the reference potential. The voltages applied to the lamps RLa, RLb and RLc by secondary windings 40*a*, 40*b* and 40*c* are sampled by the additional secondary windings 43*a*, 43*b* and 43*c*, rectified by diodes 46*a*, 46*b* and 46*c* and fed into pin VL by scaling resistor 31.

Ballast 10 operates as follows: Inverter 16 converts the substantially DC voltage generated by DC source 13 into an AC voltage which is supplied across outputs 23 and 25. Controller 25 controls the AC voltage generated by inverter 16 so as to initially develop a sufficiently high voltage across lamps RLa, RLb and RLc to ignite the latter and thereafter to operate lamps RLa, RLb and RLc in a steady state mode. Lamps RLa, RLb and RLc each have substantially the same level of current flow through serial coupling of the primary windings and resonant inductor to each other. There is no need to provide separate chokes for each lamp in order to balance the current flow among the lamps. The current flowing through resistor 46 reflects/senses the flow of current through all lamps.

Controller 25 in response to the sensed lamp current controls the switching operation of inverter 16 in order to achieve/maintain one or more desired lamp parameters.

As can now be readily appreciated, through the use of a single sense element and a single controller, the ballast avoids the need for separate feedpaths for sensing individual lamp conditions and/or the need for separate controllers for controlling the individual lamp conditions. The ballast scheme therefore avoids the use of expensive components (e.g. controllers and chokes) and minimizes the number of components required in order to operate multiple lamps.

It will thus be seen that the objects set forth above and those made apparent from the preceding description are efficiently attained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What I claim is:

1. A ballast for powering more than one lamp, comprising:

an inverter having an output;

a resonant inductor;

a transformer for each lamp, each transformer having a primary winding and a secondary winding, the primary windings being serially coupled together and to the resonant inductor;

a single sensing element for sensing the flow of current through all lamps, the single sensing element being connected between a secondary winding of one of the transformers and a reference potential; and a controller for controlling the switching operation of the inverter in response to the sensed lamp current;

wherein each transformer has a secondary winding connected to a corresponding lamp.

2. A method of operating a ballast for powering more than one lamp, comprising the following steps:

supplying an AC signal from an inverter to a resonant inductor and a plurality of transformers wherein the serial combination of the resonant inductor and primary windings of each transformer receive the AC signal, with each transformer associated with a different lamp;

sensing through a single sensing element the flow of current through all lamps; and controlling the switching operation of the inverter in response to the sensed lamp current.

3. The method of claim 2, further including operating the inverter at a switching frequency above a resonant frequency, the resonant frequency being based on the impedance of the resonant inductor and each transformer.

4. A ballast for powering plural lamps, comprising:

an inverter having an output;

a resonant inductor;

a transformer for each lamp, each transformer having a primary winding and a secondary winding, the primary windings being serially coupled together and to the resonant inductor;

a single sensing element for sensing the flow of current through all lamps; and a controller for controlling the switching operation of the inverter in response to the sensed lamp current.

5. The ballast of claim 4, wherein the single sensing element is connected between a secondary winding of one of the transformers and a reference potential.

6. The ballast of claim 4 wherein a single controller controls the switching frequency of the inverter in response to the sensed lamp current in a manner so as to maintain at least one desired lamp parameter of each of the plural lamps.

7. The ballast of claim 4, wherein each transformer has a secondary winding connected to a corresponding lamp.

8. The ballast of claim 7 wherein the secondary windings of the transformers are connected in parallel to the single sensing element.

9. The ballast of claim 4, wherein the inverter operates at a switching frequency above a resonant frequency, the resonant frequency being based on the impedance of the resonant inductor and each transformer.

10. The ballast of claim 9 wherein the resonant frequency is further based on the parasitic capacitance of the transformers.

11. An apparatus for energizing multiple discharge lamps, comprising:

an inverter having an output;

a resonant inductor;

a transformer for each lamp, each transformer having a primary winding and a secondary winding, first means connecting the resonant inductor in series circuit with the primary windings of the transformers to the output of the inverter, second means connecting the secondary winding of each transformer to a respective discharge lamp, a single sensing element for sensing the flow of current through at least one of the discharge lamps, and a single controller for controlling the switching operation of the inverter in response to the sensed lamp current.

12. The discharge lamp energizing apparatus as claimed in claim 11 wherein the resonant inductor, the transformer windings and the parasitic capacitance of the transformer windings together form a resonant circuit having a resonant frequency, and wherein the single controller controls the inverter switching frequency so that said switching frequency is higher than said resonant frequency.

13. The discharge lamp energizing apparatus as claimed in claim 11 wherein the secondary windings of the transformers are connected in parallel and via said single sensing element to a point of reference voltage.

14. The discharge lamp energizing apparatus as claimed in claim 11 wherein the discharge lamps carry equal currents and the single sensing element senses the current flow through only one of the discharge lamps.

15. The discharge lamp energizing apparatus as claimed in claim 11 wherein the discharge lamps carry equal currents and the single sensing element senses the current flow through all of the discharge lamps.

16. The discharge lamp energizing apparatus as claimed in claim 11 further comprising means for supplying a control signal to said single controller that is determined by the level of current flow through the resonant inductor.

17. The discharge lamp energizing apparatus as claimed in claim 11 wherein the single sensing element is connected between a secondary winding of one of the transformers and a reference potential.

18. The discharge lamp energizing apparatus as claimed in claim 11 wherein the resonant inductor, the transformer windings and the parasitic capacitance of the transformer windings together form a single resonant circuit.

19. The discharge lamp energizing apparatus as claimed in claim 11 wherein at least one transformer has a further secondary winding that has a voltage induced therein that is based upon the voltage applied to the respective discharge lamp of said one transformer, and means for coupling said induced voltage to a control input of the single controller.

20. The discharge lamp energizing apparatus as claimed in claim 19 wherein the single sensing element supplies a further control voltage to a further control input of the single controller and based upon the sensed lamp current.

* * * * *